US006338531B1

(12) United States Patent
Hausherr et al.

(10) Patent No.: US 6,338,531 B1
(45) Date of Patent: Jan. 15, 2002

(54) STAND-ASSIST RECLINER CHAIR

(75) Inventors: Klaus Hausherr, Wetter; Martin Kristen, Gelsenkirchen, both of (DE)

(73) Assignee: Stanzwerk Wetter Sichelschmidt GmbH & Co. KG, Wetter (DE)

( * ) Notice: Subject to any disclaimer, the term of this patent is extended or adjusted under 35 U.S.C. 154(b) by 0 days.

(21) Appl. No.: 09/456,630

(22) Filed: Dec. 8, 1999

(30) Foreign Application Priority Data

Dec. 9, 1998 (DE) ..... 298 21 875 U
Sep. 21, 1999 (DE) ..... 199 45 118

(51) Int. Cl.[7] ..... A47C 1/02
(52) U.S. Cl. ..... 297/330; 297/83
(58) Field of Search ..... 297/330, 83, 84, 297/DIG. 7, 316, 318, 329

(56) References Cited

U.S. PATENT DOCUMENTS 4,072,342 A * 2/1978 Johnson et al. ..... 297/318 X
4,195,878 A * 4/1980 Cycowicz et al. ..... 297/318 X
5,024,486 A * 6/1991 Auel ..... 297/330
5,215,351 A * 6/1993 Lapointe ..... 297/330 X
5,265,935 A * 11/1993 Geisler et al. ..... 297/330 X
5,294,179 A * 3/1994 Rudes et al. ..... 297/330
5,314,238 A * 5/1994 Komorowski et al. .. 297/330 X
5,895,093 A * 4/1999 Casey et al. ..... 297/330 X

* cited by examiner

*Primary Examiner*—Peter M. Cuomo
*Assistant Examiner*—Stephen Vu
(74) *Attorney, Agent, or Firm*—Herbert Dubno; Andrew Wilford

(57) ABSTRACT

A stand-assist chair has a base frame adapted to stand on the floor, a seat frame movable above the base frame and carrying a generally horizontal seat, a back on the seat frame extending upward from a rear edge of the seat, and a motor housing on one of the frames. Front and back actuating shafts are journaled in the motor housing under front and rear edges of the seat and have respective front and back actuating arms and respective front and back operating arms. The front arm has an outer end pivoted on the other of the frames adjacent a front edge of the seat and the rear arm has an outer end operatively coupled to the other of the frames adjacent the rear seat edge.

9 Claims, 9 Drawing Sheets

STAND-ASSIST RECLINER CHAIR

FIELD OF THE INVENTION

The present invention relates to a piece of furniture. More particularly this invention concerns a recliner chair that can be moved into a stand-assist position making it easy to get out of the chair.

BACKGROUND OF THE INVENTION

A standard recliner chair comprises a base frame that typically sits on the floor, a seat frame carrying a generally horizontal seat cushion, a back which may be fixed on the seat frame or pivot relative to it, and in some instances a footrest that can also pivot relative to at least one of the frames. Such a chair is typically movable between a standard sitting position with the back and footrest generally vertical and a reclining position with the back and footrest much more horizontal and the upper end of the back slightly above the footrest. Often in the reclining position the seat is also inclined somewhat downward from the inner edge of the foot rest to the lower edge of the back for comfort. Variations on the reclining position place the upper end of the back well above the footrest for watching television or reading, or placing the upper end of the backrest level with or below the footrest for cardiovascular purposes.

It is also known for example from U. S. Pat. No. 5,265,935 for a stand-assist chair to have a base, front and back wheels on the base normally supporting it rollably on a floor, a seat having a front edge and a back edge, a back extending upward from the back edge of the seat, and a pair of lever systems engaged between the seat and the base operable to displace the seat between a normal sitting position with the seat front edge somewhat above the seat rear edge and a stand-assist position with the seat rear edge somewhat above the seat front edge and the entire seat elevated above the level it occupies relative to the base in the normal sitting position. A drive motor is engaged with the lever system for displacing the seat between its positions. A pair of feet are movable on the base between a retracted position above a plane defined by lowermost surfaces of the wheels and an extended position projecting downward past the plane and lifting at least one of the wheels off the floor. Links are connected between the lever systems and the feet for automatically displacing the feet into the extended position when the seat is in the stand-assist position.

Such systems are typically driven by a pair of shafts that must withstand the considerable forces they exert via the various lever systems on the seat, back, footrest, and frame. There is a tradeoff therefore between expensive sturdy construction certain to have a long service life and cheaper less robust design likely to lead to failure. Furthermore the chairs cannot readily be brought into any of several different positions, such as the full-rest position with the footrest level with or even slightly above the head.

OBJECTS OF THE INVENTION

It is therefore an object of the present invention to provide an improved stand-assist recliner chair.

Another object is the provision of such an improved stand-assist recliner chair which overcomes the above-given disadvantages, that is which is of robust but simple and inexpensive construction and which can assume a plurality of different positions.

SUMMARY OF THE INVENTION

A stand-assist chair has according to the invention a base frame adapted to stand on the floor, a seat frame movable above the base frame and carrying a generally horizontal seat, a back on the seat frame extending transversely upward from a rear edge of the seat, and a motor housing on one of the frames. Front and back actuating shafts are journaled in the motor housing under front and rear edges of the seat and have respective front and back actuating arms and respective front and back operating arms. The front arm has an outer end pivoted on the other of the frames adjacent a front edge of the seat and the rear arm has an outer end operatively coupled to the other of the frames adjacent the rear seat edge. A drive includes respective independently operable front and rear motors connected to the actuating arms for rotating the respective shafts so as to move the front and rear seat edges independently of each other between respective lower, intermediate, and upper positions so that the chair can assume a sitting or reclining position in the lower positions of the seat edges, a stand-assist position in the upper positions of the seat edges, and other positions in the intermediate positions of the seat edges.

The use of independent motors allows the chair to assume several different positions since in each of the lower, intermediate, and upper positions of one of the shafts, the other shaft can be in the lower, intermediate, or upper position, making it technically possible to assume nine different positions. Normally the most useful positions are the sitting position in which both the shafts are in their lower position, and the described stand-assist position in which both the shafts have pivoted their arms to the respective upper positions. The intermediate positions are used for reclining, cardiovascular full rest with elevated feet, or even reclining but with the head up for watching television or reading.

The drive assembly is largely self contained and the two shafts, which can be positioned horizontally well apart for good mechanical advantage and excellent stability of the chair, are held at a fixed spacing from each other so that they will not bend. The system can be built of relatively light materials and still be very strong since the end walls of the housing, in which the shafts are journaled, are stressed purely in tension.

In accordance with the invention the one frame is the seat frame and the other frame is the base frame. In this case the front operating arm has an outer end and the base frame includes an upright having an upper end directly pivoted to the front-arm outer end. Furthermore there is a rigid link between an outer end of the rear arm and the base frame.

In another system according to the invention the one frame is the base frame and the other frame is the seat frame. In this case the seat frame has front and rear brackets. The front arm has an outer end pivoted directly on the front bracket and a rigid link is provided between an outer end of the rear arm and the rear bracket.

Normally according to the invention the front shaft carries two such front arms and the rear shaft carries two such rear arms. Furthermore the front arms have a shorter effective length than the rear arms so that in the stand-assist position the seat is tipped forward and down.

The housing in accordance with the invention is cup-shaped, downwardly open, formed with front and rear slots fitting over the shafts, and provided with front and rear covers closing the slots around the shafts. In addition in the sitting position the shafts are generally level with each other and the actuating arms are generally vertical.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
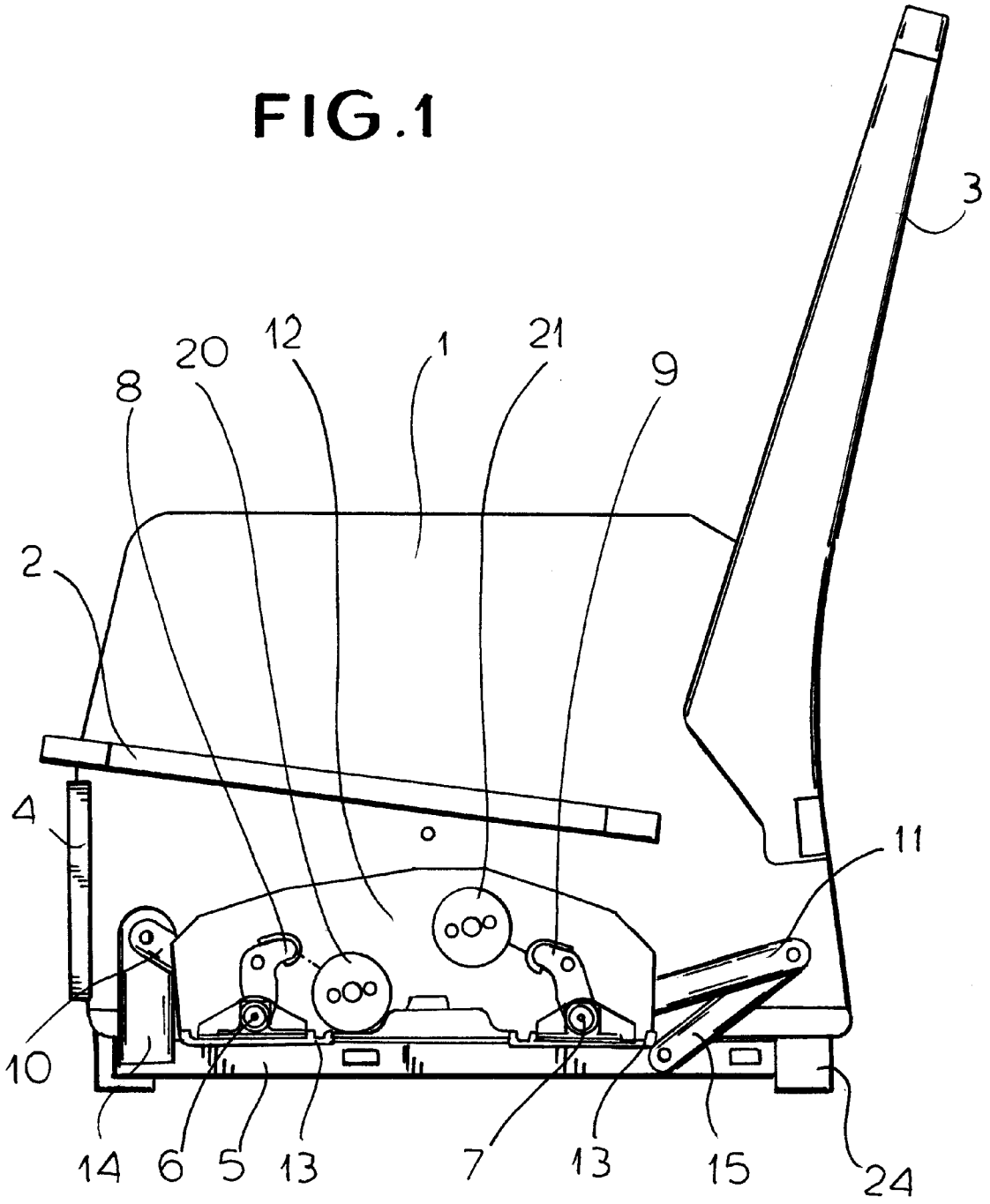
FIG. 1 is a partly diagrammatic vertical section through a chair according to the invention in the standard sitting position.

As seen in FIGS. 1 to 5, a stand-assist recliner chair according to the invention has a seat frame 1 carrying the seat 2 and normally also the arms of the chair, and on which is pivotal a seat back 3 and a footrest 4 articulated together via respective lever systems not shown in detail here but which may be of the type shown in above-cited U.S. Pat. No. 5,265,935. The seat frame 1 is displaceable as will be described below relative to a base frame 5 that normally sits on a horizontal floor or ground surface. Normally the back 3 and footrest 4 are coupled together so pushing back the back 3 raises the footrest 4 and vice versa.

Horizontal and parallel front and back shafts 6 and 7 carry respective actuating levers 8 and 9 operable by respective electric motors 20 and 21 and each carry a pair of operating arms 10 and 11 that in the normal sitting position of FIG. 1 extend somewhat upward. The motors 20 and 21 can have threaded output shafts engaging nuts carried on the outer ends of the actuating 20 arms. Normally the motors 20 and 21 are used to raise the seat frame 1 but gravity or unillustrated springs are used to return it to the lower position. The outer ends of the front arms 10 are pivoted on the upper ends of short upright columns or posts 14 fixed on the base frame 5 and the outer ends of the rear arms 11 are pivoted on respective links 15 whose opposite ends are pivoted on the frame 5 also.

In the embodiment of FIGS. 1 to 5 the motors 20 and 21 and the shafts 6 and 7 are both carried in a housing 12 fixed on the movable seat frame 1. The housing 12 is downwardly cup-shaped or open and is formed with two slots that fit over the shafts 6 and 7 and are closed with covers 13. Thus the motors 20 and 21 and the central portions of the shafts 6 and 7 and their actuating levers 8 and 9 are enclosed.

The motor 20 can therefore raise and lower the front of the seat frame 1 and the motor 21 can raise and lower the rear of the seat frame 1. As mentioned above, the pivoting of the back 3 controls the pivoting of the footrest 4 but since both the back 3 and footrest 4 are pivoted on the seat frame 1, its orientation will affect the position assumed by the chair.

Figure 2:
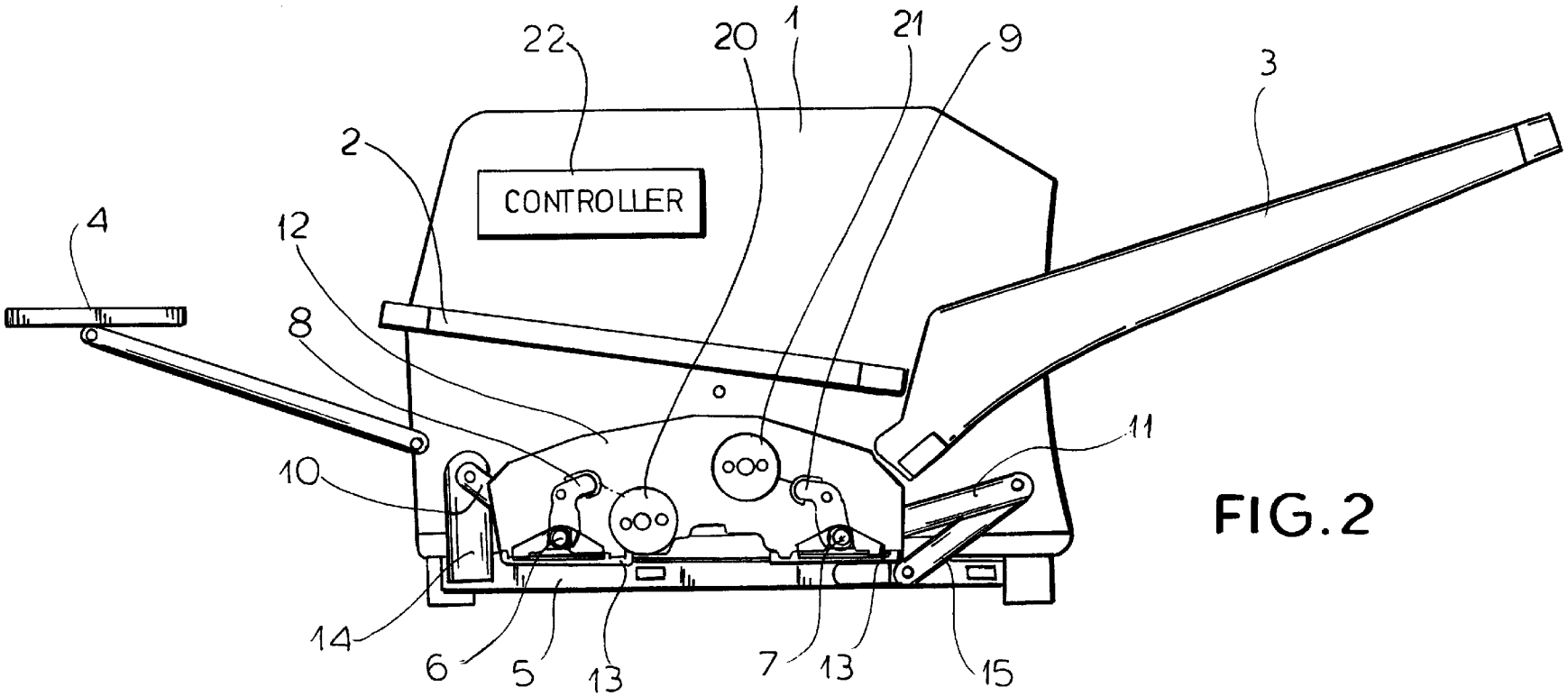
FIG. 2 is a view of the chair in the standard reclining position.

More specifically, in the standard starting sitting position shown in FIG. 1 the frame 1 is resting on the frame 5 and the two levers 8 and 9 are generally vertical with the arms 10 and 11 in their lower positions. In this position as shown in FIG. 2 the back 3 can be pushed back to raise the footrest 4 for a standard reclining position. No action by either of the motors 20 or 21 is needed for movement between the FIG. 1 sitting position and the FIG. 2 normal reclining position. Furthermore it is noted that in the sitting position the frame 1 is supported directly on the ground, via front and rear posts 24 that can directly engage the floor, even allowing the frame 5 to be raised slightly. When the posts 24 are provided with casters or wheels the chair can easily be rolled about when in the sitting position, but when in any of the other positions will not be able to roll.

Figure 3:
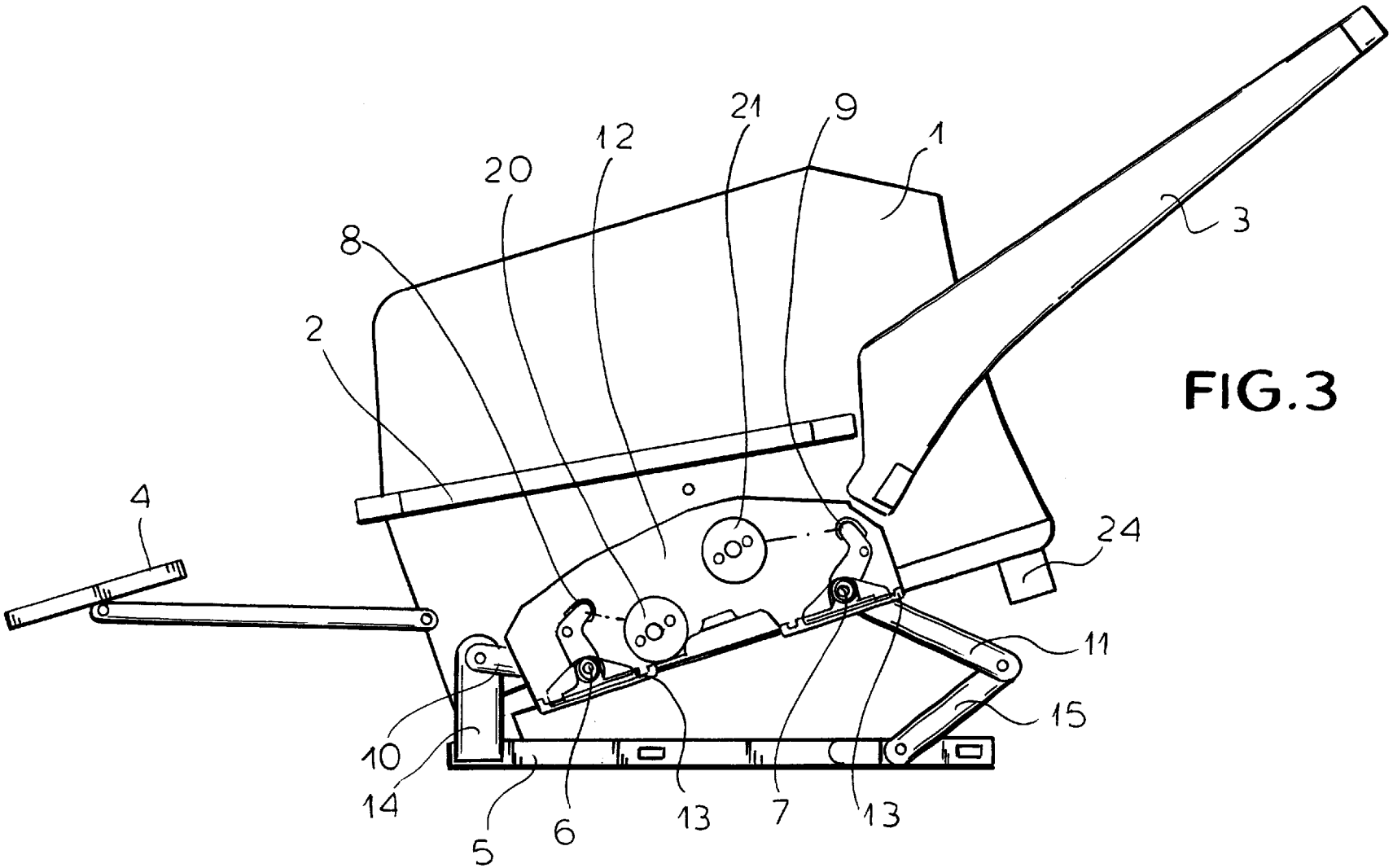
FIG. 3 is a view of the chair in a head-up reclining position intended for reading or viewing television.

If the motor 21 is operated, for example by a controller 22 on the seat frame 1, the rear of the seat frame 1 can be raised from its starting lower position to an intermediate position as shown in FIG. 3. Thus, with the back 3 in the reclining position, the entire chair assumes a reclining position suitable for reading or watching television, as the user's feet will be below his or her head.

Figure 4:
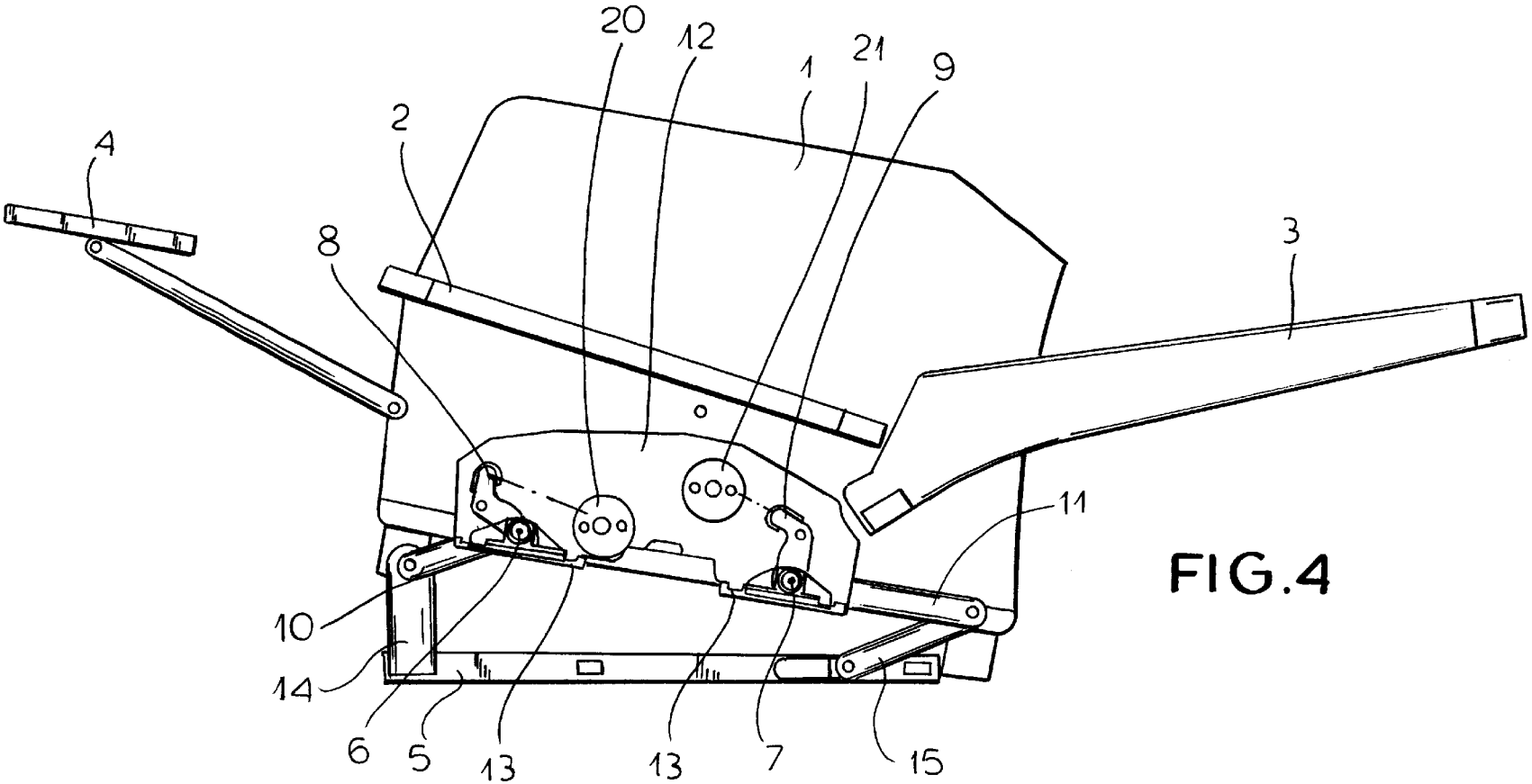
FIG. 4 is a view of the chair in a head-down full-rest reclining position.

FIG. 4 shows how the motor 20 can pivot the shaft 5 and raise only the front of the seat frame 1 from its starting lower position to an intermediate position to elevate the feet of the user. This position is considered particularly healthy for cardiovascular reasons in that it encourages blood flow down out of the legs and feet.

Figure 5:
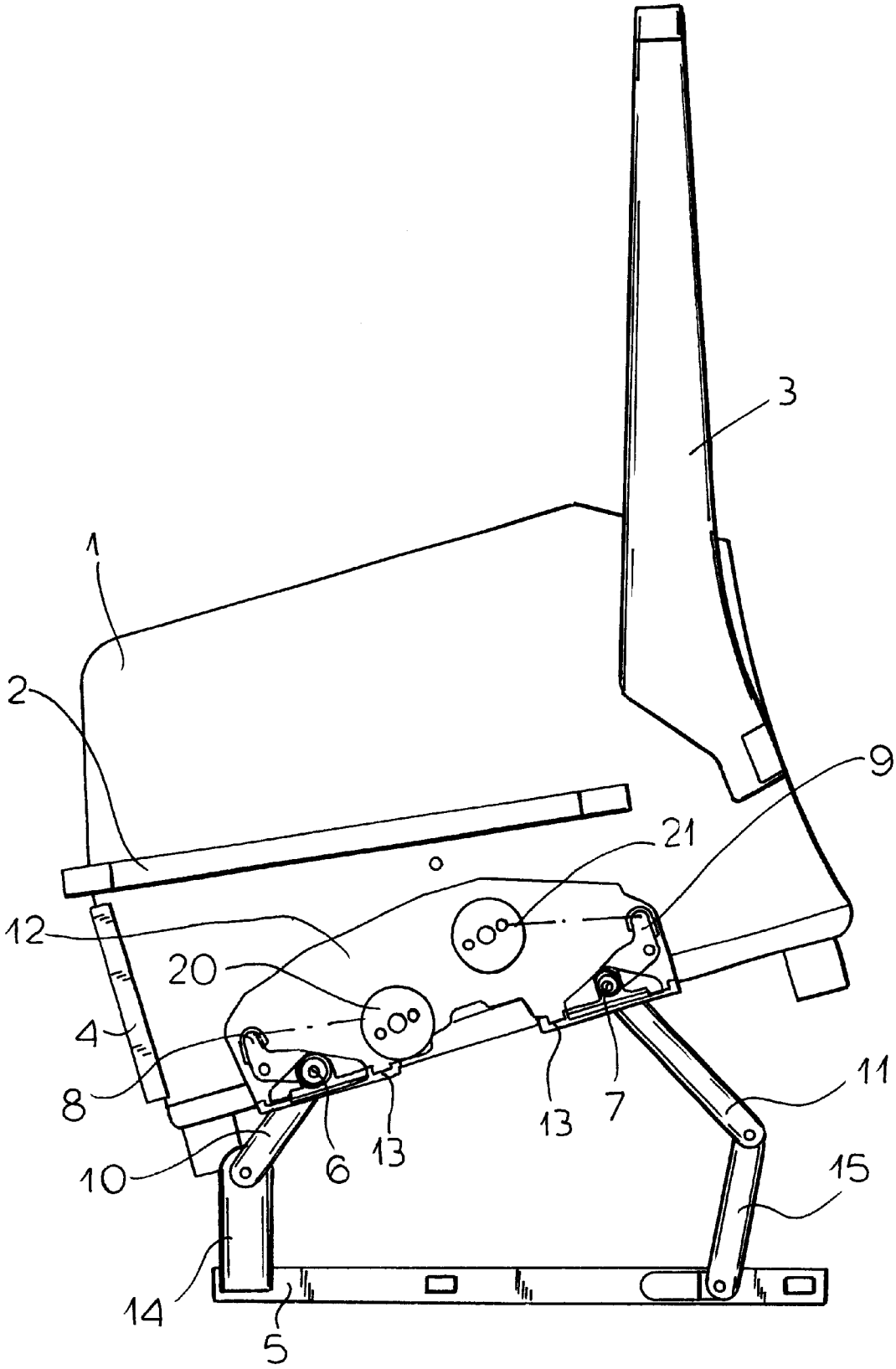
FIG. 5 is a view of the chair in the stand-assist position.

In FIG. 5 the motor 20 and 21 have rotated both the front and rear shafts 6 and 7 to move the front and rear of the seat frame 1 to upper positions above the intermediate positions, thereby inclining the seat 2 somewhat forward while holding the seat frame 1 so high that it is easy for even an infirm or crippled person to push out of the chair. The longer length of the rear levers 11 and their links 15 ensures that the rear of the seat frame 1 will be raised more than the front for an identical angular travel of the shafts 5 and 7. Such a position is also useful when a person on, for instance, a walker needs to lower himself or herself into the chair, as this can most easily be done in the FIG. 5 stand-assist position.

The arrangement of FIGS. 6 to 9 is similar to that of FIGS. 1 to 5 with functionally identical parts identified with the same reference numerals carrying primes. Here the principal difference is that the motor housing 12', the motors 20' and 21', and the shafts 6' and 7' along with their levers and arms 8', 9', 10', and 11' are carried on the stationary base frame 5' along with the arms 23. The front operating arms 10' are linked to brackets 16 fixed on the front of the seat frame 1' under the seat 2' and the back arms 11' are linked through short links 18 to rear brackets 17 on the seat frame 1'. Here the back 3' is fixed on the seat frame 1' with the seat 2', and the footrest 4' is fixed on the base frame 5'.

Figure 6:
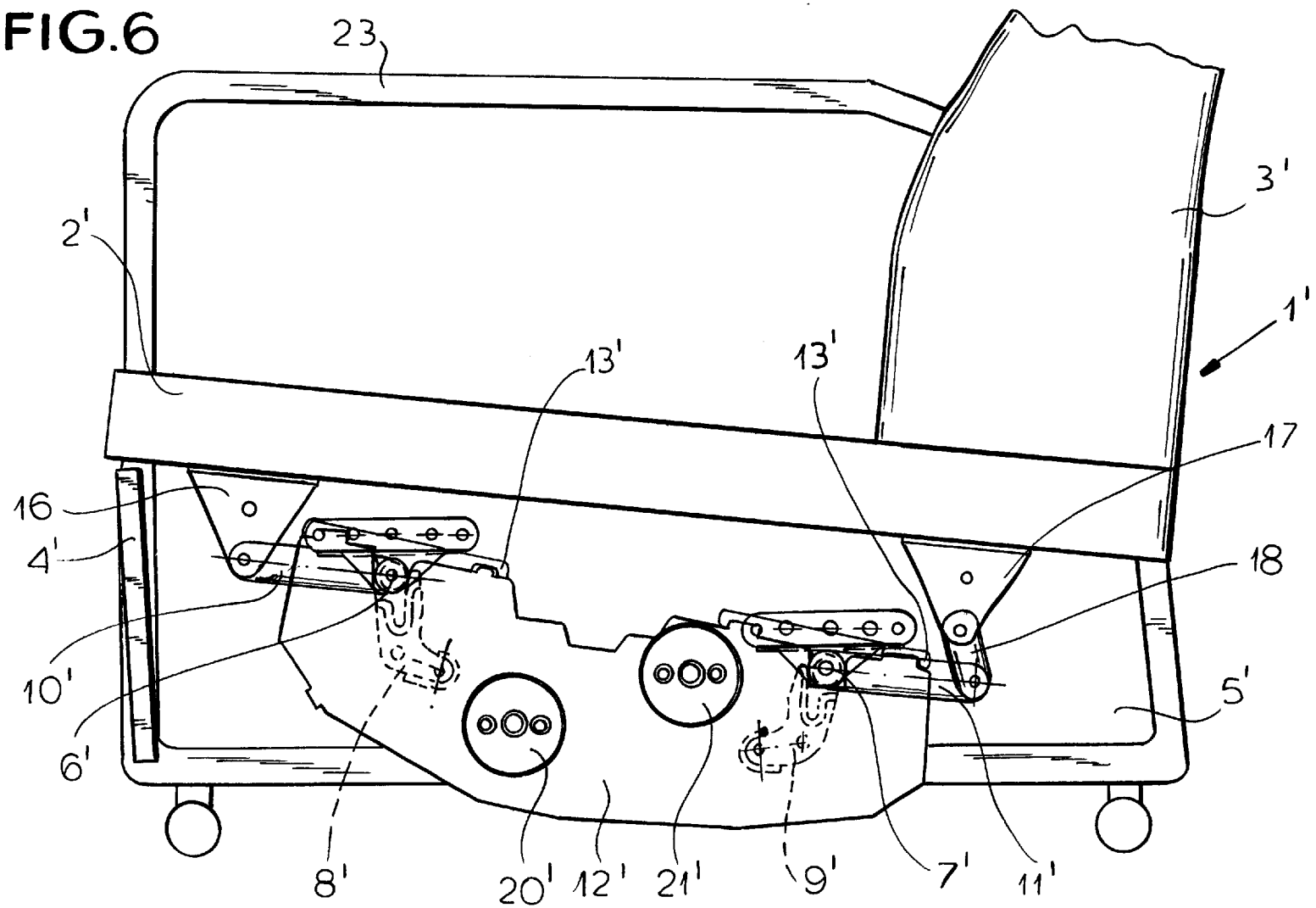
FIG 6 is a view of another chair in accordance with the invention in the sitting position.
Figure 7:
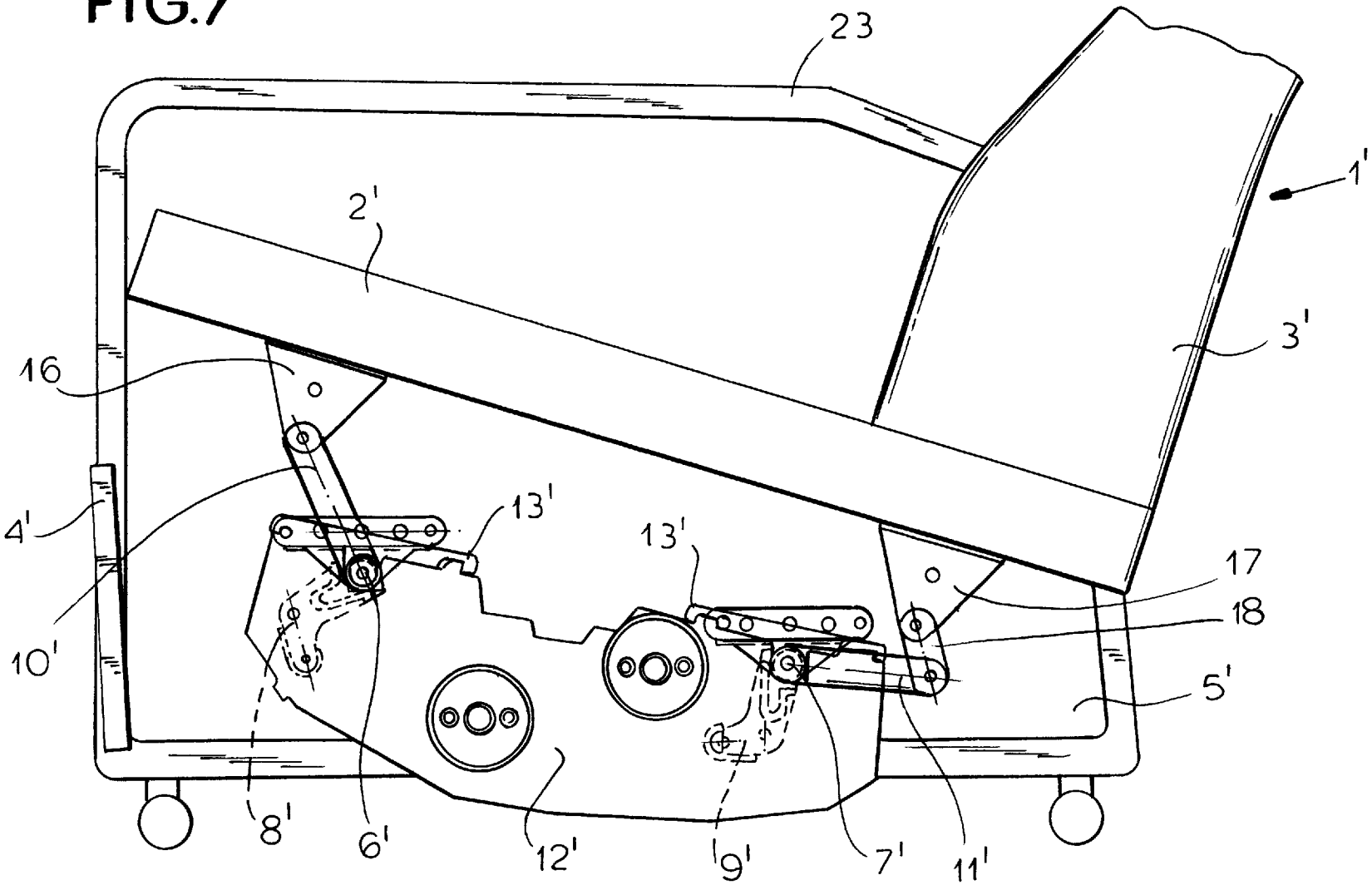
FIG. 7 is a view of the other chair in the reclining position.
Figure 8:
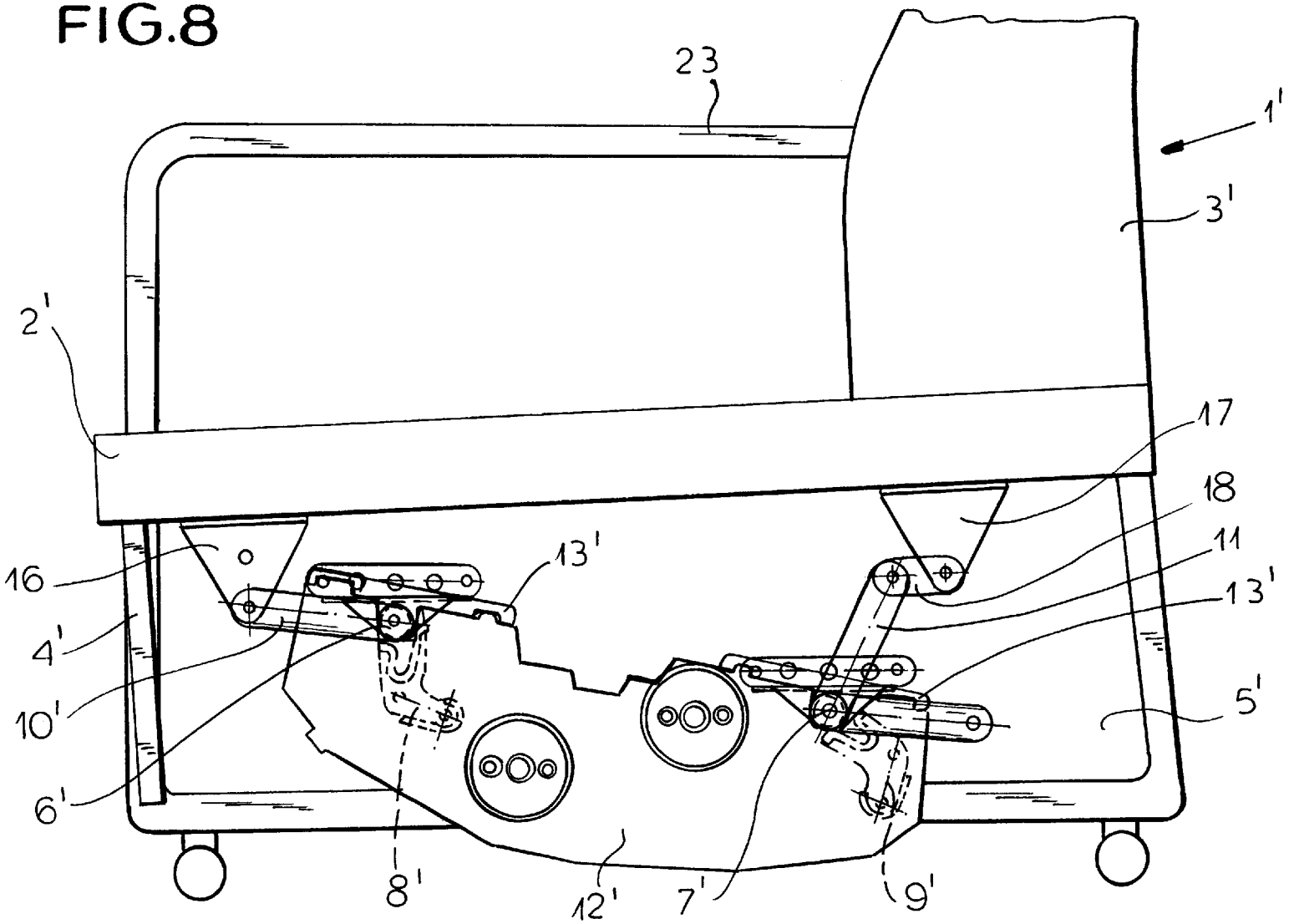
FIG. 8 is a view of the other chair in the stand-assist position.
Figure 9:
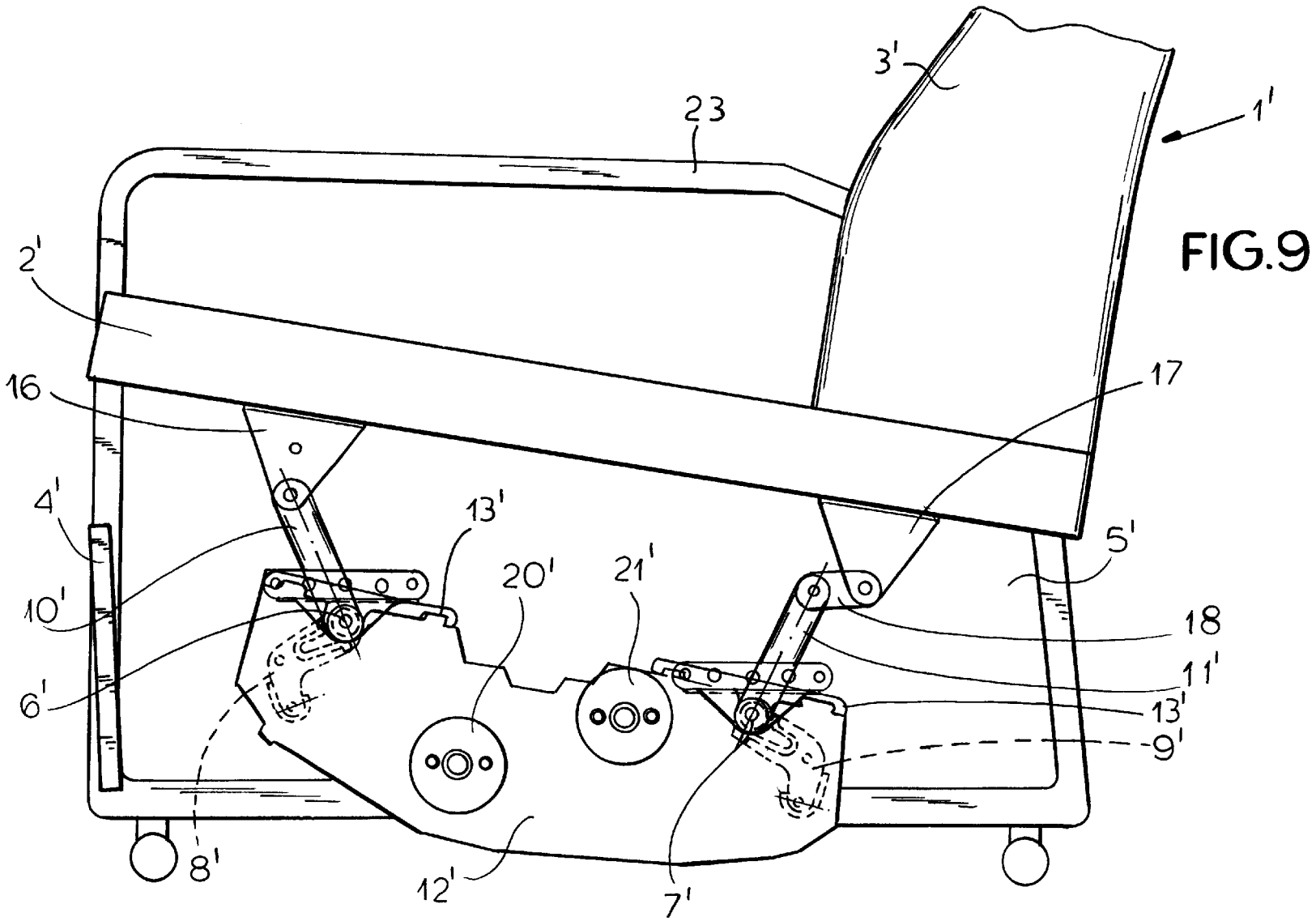
FIG. 9 is a view of the other chair in a raised position.

FIG. 6 shows the standard sitting position with the seat frame 1' in its lowered position sitting on the base frame 5'. In FIG. 7 the front of the seat frame 1 is raised for reclining. FIG. 8 shows a position with the back of the seat frame 1' raised somewhat, and FIG. 9 shows a position with both the front and back raised for an elevated sitting position, advantageous for a short person.

We claim:

1. A stand-assist chair comprising:

a base frame adapted to stand on the floor;

a seat frame movable above the base frame and carrying a generally horizontal seat;

a back on the seat frame extending upward from a rear edge of the seat;

a motor housing fixed on one of the frames and having a pair of laterally spaced end walls;

front and back actuating shafts having ends journaled in the end walls of the motor housing under front and rear edges of the seat;

respective front and back actuating arms on and extending radially from the shafts;

respective pairs of front and back operating arms on and extending radially from the ends of the shafts, the front operating arms having outer ends pivoted on the other of the frames adjacent a front edge of the seat and the rear operating arms having outer ends operatively coupled to the other of the frames adjacent the rear seat edge; and drive means including respective independently operable front and rear motors fixed in the motor housing and connected to the respective actuating arms for rotating the respective shafts so as to move the front and rear seat edges independently of each other between respective lower, intermediate, and upper positions, whereby the chair can assume a sitting or reclining position in the lower positions of the seat edges, a stand-assist position in the upper positions of the seat edges, and other positions in the intermediate positions of the seat edges.

2. The stand-assist chair defined in claim 1 wherein the one frame is the seat frame and the other frame is the base frame.

3. The stand-assist chair defined in claim 2 wherein the front operating arms each have an outer end and the base frame includes respective uprights having upper ends directly pivoted to the front operating-arm outer ends.

4. The stand-assist chair defined in claim 3, further comprising respective rigid links between outer ends of the rear arms and the base frame.

5. The stand-assist chair defined in claim 1 wherein the one frame is the base frame and the other frame is the seat frame.

6. The stand-assist chair defined in claim 5 wherein the seat frame has front and rear pairs of brackets, the front arms having outer ends pivoted directly on the front brackets, the chair further comprising respective rigid links between outer ends of the rear arms and the rear brackets.

7. The stand-assist chair defined in claim 1 wherein the housing is cup-shaped and downwardly open and the end walls are each formed with front and rear slots fitting over the respective shafts and are each provided with front and rear covers closing the respective slots around the respective shafts.

8. The stand-assist chair defined in claim 1 wherein in the sitting position the shafts are generally level with each other and the actuating arms are generally vertical.

9. The stand-assist chair defined in claim 1 wherein the front arms have shorter effective lengths than the rear arms, whereby in the stand-assist position the seat is tipped forward and down.

* * * * *